US011219316B2

(12) United States Patent
Murphy

(10) Patent No.: US 11,219,316 B2
(45) Date of Patent: Jan. 11, 2022

(54) FOLDABLE SOFA-BED

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 1161 days.

(21) Appl. No.: 15/668,066

(22) Filed: Aug. 3, 2017

(65) Prior Publication Data

US 2018/0064258 A1 Mar. 8, 2018

Related U.S. Application Data

(60) Provisional application No. 62/383,906, filed on Sep. 6, 2016.

(51) Int. Cl.

| | |
|---|---|
| ***A47C 17/22*** | (2006.01) |
| ***A47C 17/23*** | (2006.01) |
| ***A47C 17/28*** | (2006.01) |
| ***A47C 17/86*** | (2006.01) |
| ***A47C 17/13*** | (2006.01) |

(52) U.S. Cl.

CPC ..... *A47C 17/225* (2013.01); *A47C 17/138* (2013.01); *A47C 17/22* (2013.01); *A47C 17/23* (2013.01); *A47C 17/28* (2013.01); *A47C 17/86* (2013.01)

(58) Field of Classification Search

CPC ..... A47C 17/225; A47C 17/138; A47C 17/22; A47C 17/23; A47C 17/28; A47C 17/86; A47C 17/134; A47C 17/207; A47C 17/2076; A47C 19/024

See application file for complete search history.

(56) References Cited

U.S. PATENT DOCUMENTS

| | | | | |
|---|---|---|---|---|
| 2,740,131 | A | 4/1965 | Vogel et al. | |
| 3,389,409 | A * | 6/1968 | Rogers, Jr. ..... | A47C 17/134 5/17 |
| 4,200,941 | A | 5/1980 | Gill et al. | |
| 4,651,363 | A * | 3/1987 | Mizelle ..... | A47C 17/175 297/411.28 |
| 5,195,194 | A | 3/1993 | Bradley et al. | |
| 7,549,182 | B2 | 6/2009 | Murphy | |
| 8,438,676 | B2 | 5/2013 | Murphy | |

FOREIGN PATENT DOCUMENTS

EP 1989972 A1 * 11/2008 ..... A47C 17/2073

OTHER PUBLICATIONS

U.S. Appl. No. 13/900,311, Murphy et al., filed May 22, 2013.

* cited by examiner

*Primary Examiner* — Nicholas F Polito
(74) *Attorney, Agent, or Firm* — Myers Bigel, P.A.

(57) ABSTRACT

A foldable sofa-bed includes: a base having a cavity; a bed with a seat section and a subseat section, each of the seat section and the subseat section including a cushion and an underlying panel; and a bed folding mechanism attached to the base, subseat and seat. The bed folding mechanism is configured to move the bed between a folded position, in which the seat and subseat sections are generally horizontally disposed and positioned in vertically stacked relationship in the cavity of the base, with the seat and subseat cushions facing upwardly, and an unfolded position, in which the seat and subseat sections are horizontally disposed and aligned to form a sleeping surface.

9 Claims, 4 Drawing Sheets

FOLDABLE SOFA-BED

RELATED APPLICATION

The present application claims priority from and the benefit of U.S. Provisional Patent Application No. 62/383,906, filed Sep. 6, 2016, the disclosure of which is hereby incorporated herein in its entirety.

FIELD OF THE INVENTION

The present invention relates generally to furniture, and more specifically a furniture unit that is convertible into a bed.

BACKGROUND OF THE INVENTION

Furniture units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other furniture units lack a complete mattress, but instead are constructed of separate sections that serve as support surfaces of the sofa and unfold to, form a flat, mattress-like sleeping surface. Different examples of this basic concept are shown in U.S. Pat. No. 2,740,131 to Vogel et al., U.S. Pat. No. 5,195,194 to Bradley, U.S. Pat. No. 7,549,182 to Murphy, and U.S. Pat. No. 8,438,676 to Murphy, the disclosure of each of which is hereby incorporated herein in its entirety. The bed shown in the latter of the Murphy patents includes three separate sections that serve as the mattress of the bed: a seat section; an intermediate section; and a head section. A folding mechanism controls the movement of the head, intermediate and seat sections between a folded position, in which the head, intermediate and seat sections are positioned in a vertically stacked relationship, with the head section below the intermediate section and the seat section above the intermediate section, and with the head and intermediate sections being positioned in the cavity of the housing and the seat section serving as the "seat" for the sofa, and an unfolded position, in which the head, intermediate and seat sections are horizontally disposed and serially aligned to form a sleeping surface.

In spite of the existence of these different foldable beds, it may be desirable to offer additional furniture units that can house foldable beds.

SUMMARY

As a first aspect, embodiments of the invention are directed to a foldable sofa-bed. The foldable sofa-bed comprises: a base having a cavity; a bed with a seat section and a subseat section, each of the seat section and the subseat section including a cushion and an underlying panel; and a bed folding mechanism attached to the base, subseat and seat. The bed folding mechanism is configured to move the bed between a folded position, in which the seat and subseat sections are generally horizontally disposed and positioned in vertically stacked relationship in the cavity of the base, with the seat and subseat cushions facing upwardly, and an unfolded position, in which the seat and subseat sections are horizontally disposed and aligned to form a sleeping surface.

As a second aspect, embodiments of the invention are directed to a foldable sofa-bed, comprising: a base having a cavity; a bed with a seat section and a subseat section, each of the seat section and the subseat section including a cushion and an underlying panel; and a bed folding mechanism attached to the base, subseat and seat. The bed folding mechanism is configured to move the bed between a folded position, in which the seat and subseat sections are generally horizontally disposed and positioned in vertically stacked relationship in the cavity of the base, with the seat and subseat cushions facing upwardly, and an unfolded position, in which the seat and subseat sections are horizontally disposed and aligned to form a sleeping surface. The rear edge of the seat section is angled to face downwardly, and the front edge of the subseat section is angled to face upwardly; the rear edge of the seat section engages a front edge of the subseat section in the unfolded position. As the bed moves from the folded position to the unfolded position, a final portion of a path followed by the seat is generally parallel to an angle defined by the front edge of the subseat section.

DETAILED DESCRIPTION

Figure 1:
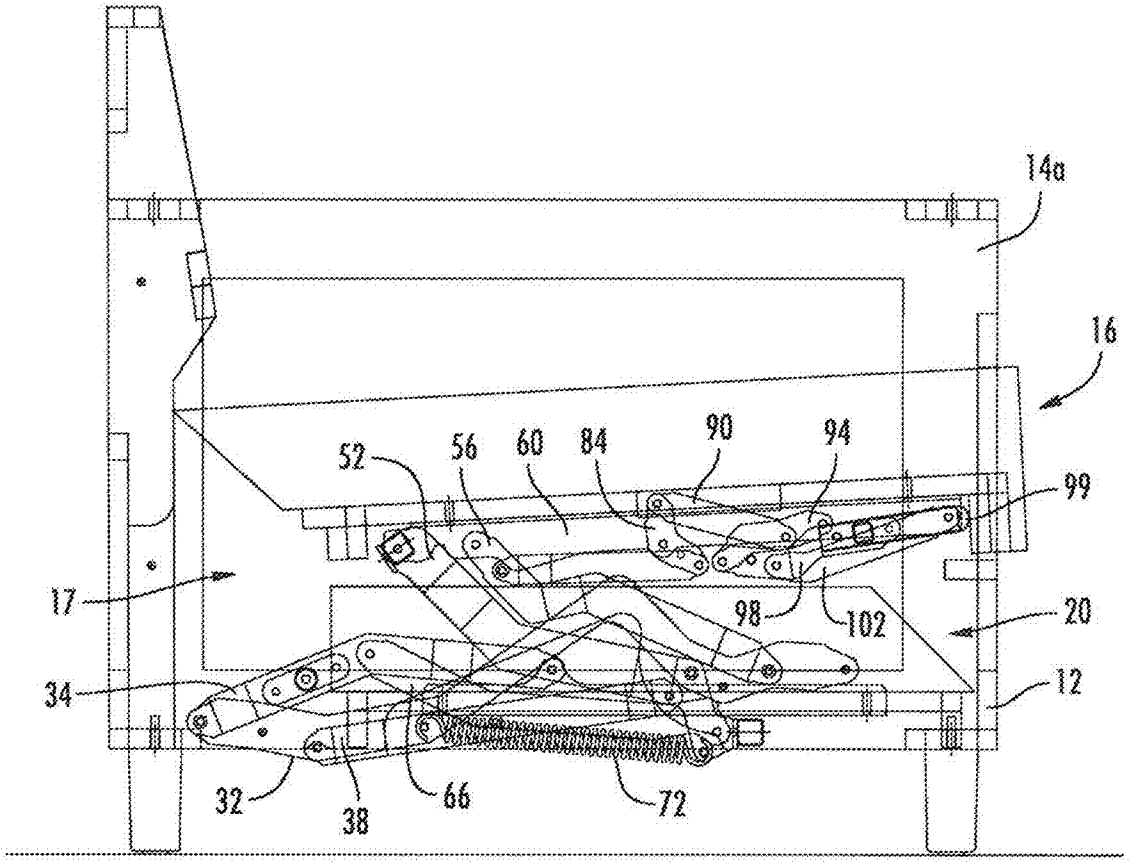
FIG. 1 is a side view of a foldable sofa-bed shown in the folded position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Figure 2:
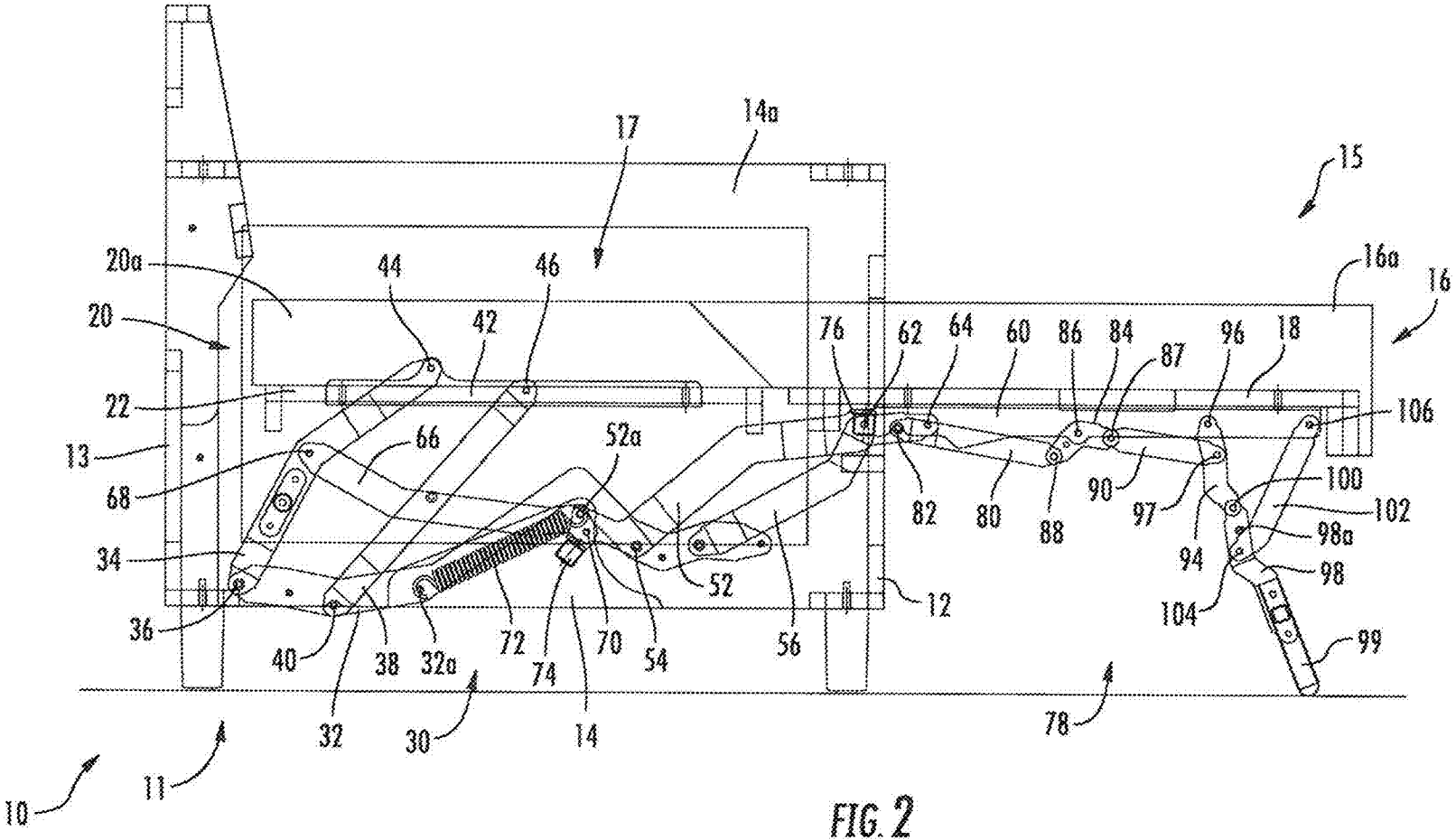
FIG. 2 is a side view of the sofa-bed of FIG. 1 shown in the unfolded position.
Figure 3:
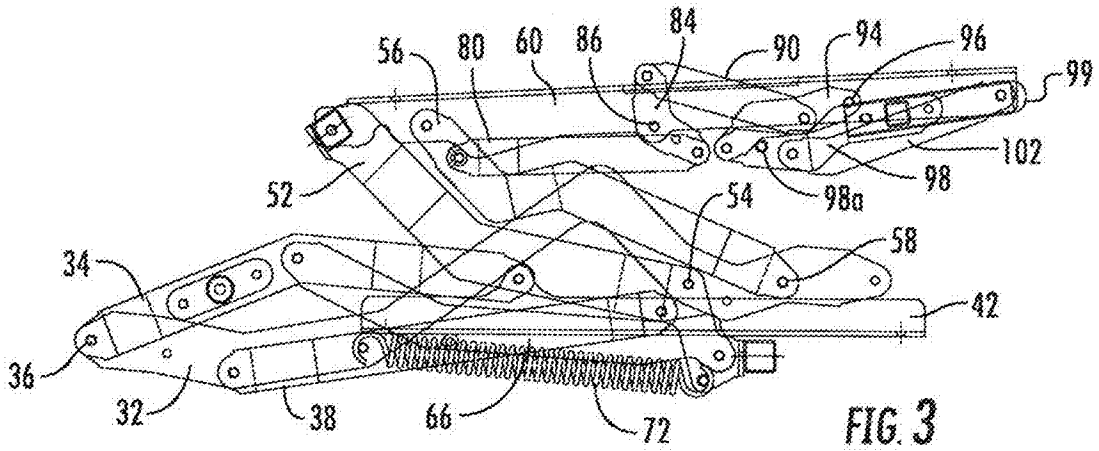
FIG. 3 is a side view of the folding mechanism of the sofa-bed of FIG. 1 shown in the folded position.
Figure 4:
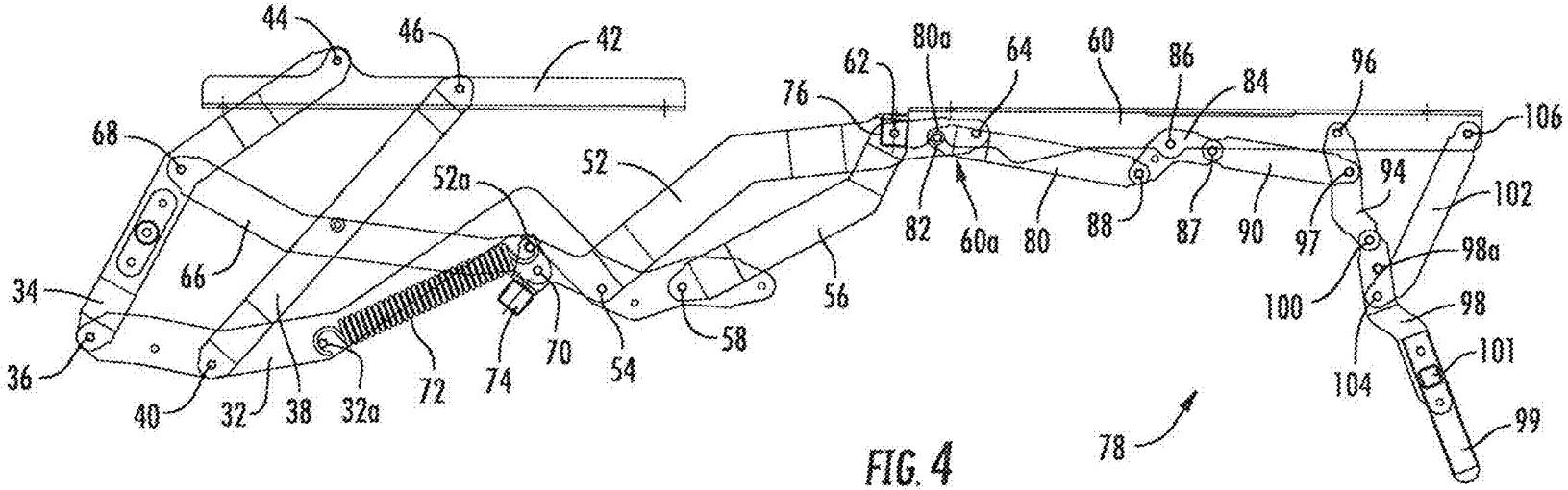
FIG. 4 is a side view of the folding mechanism of the sofa-bed of FIG. 1 shown in the folded position.
Figure 5:
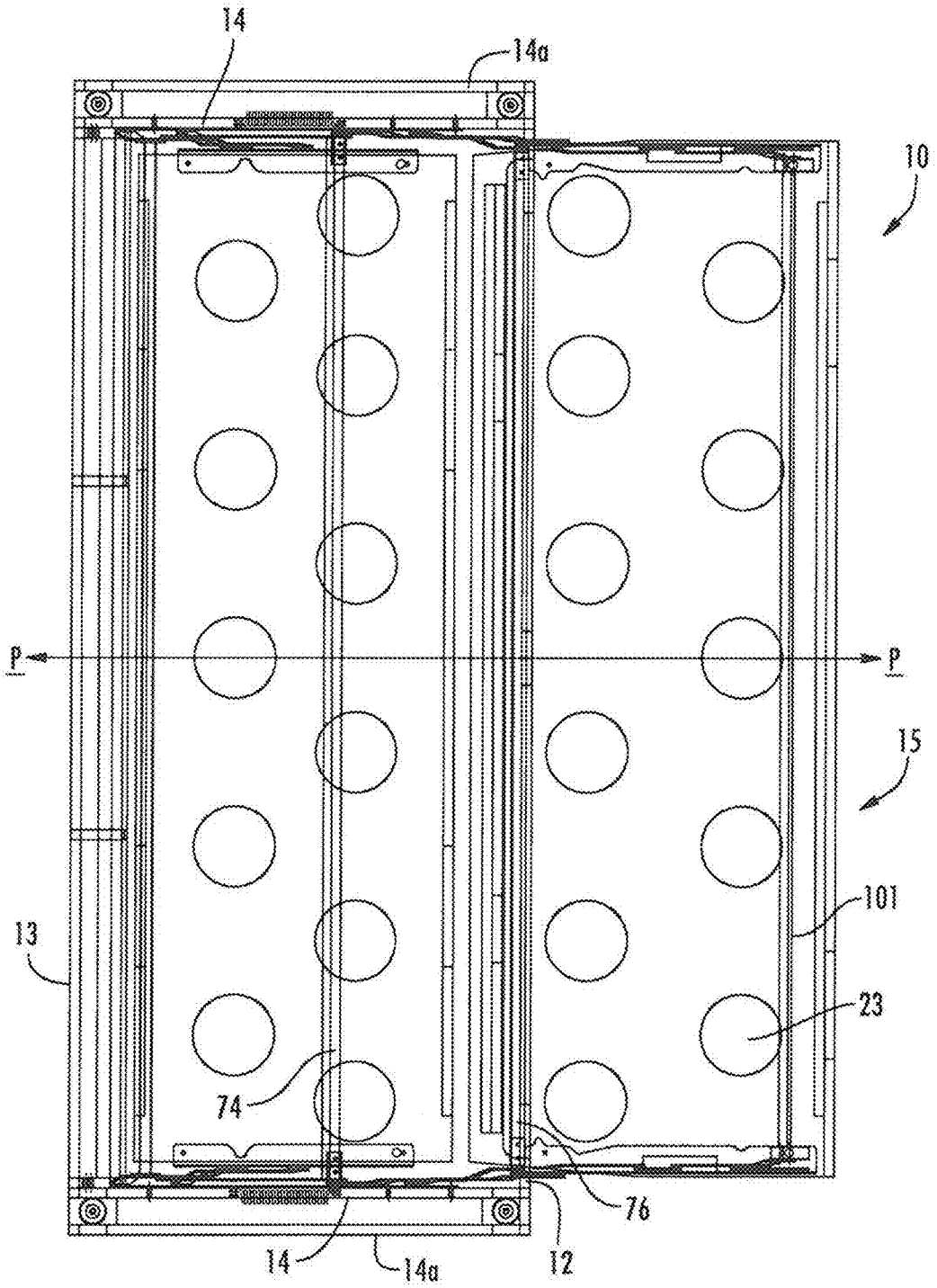
FIG. 5 is a top view of the sofa-bed of FIG. 1 shown in the unfolded position.

Referring now to the figures, a seating unit, designated broadly at 10, is illustrated in FIGS. 1-5. Referring first to FIGS. 2 and 5, the seating unit 10 includes a base 11 having a front wall 12, a rear wall 13, and opposed side walls 14 with arms 14*a* (see FIG. 5); the walls 12, 13 and 14 define a cavity 17. A foldable bed 15 includes a seat section 16 having a cushion 16*a* with an underlying seat panel 18 and a subseat section 20 having a cushion 20*a* with an underlying intermediate panel 22. The seat and subseat panels 18, 22 are planar panels, typically formed of wood, that underlie most or all of cushions 16*a*, 20*a*; the cushions 16*a*, 20*a* provide a comfortable surface for sleeping. As can be seen in FIG. 5, the seat and subseat panels 18, 22 include holes 23 that can lighten the weight of the seating unit 10. In other embodiments, the seat panel 18 may comprise two or more open square subframes described in some detail in co-assigned and co-pending U.S. patent application Ser. No. 13/900,311, filed on May 22, 2013, the disclosure of which is hereby incorporated herein in its entirety.

The bed 15 is movable between a folded position, in which the seat and subseat sections 16, 20 are generally horizontally disposed and positioned in vertically stacked relationship in the cavity 17, with the cushions 16*a*, 20*a* facing upward (see FIG. 1), and an unfolded position, in which the seat and subseat sections 16, 20 are horizontally disposed and aligned to form a sleeping surface (see FIGS. 2 and 5). In the folded position, the cushion 16*a* of the seat section 16 provides a surface for sitting. In the unfolded position, the seat section 16 is largely, if not entirely, forward of the base 11.

The movement of the sections 16, 20 of the bed 15 is controlled by a pair of bed folding mechanisms 30, which will be described in greater detail below. The bed folding mechanisms 30 are mirror images of each other about a vertical plane P (FIG. 5) that bisects the seating unit 10 normal to the front wall 12; as such, only one bed folding mechanism 30 will be described herein, with the understanding that the description is applicable to the other mechanism also. Also, two leg folding mechanisms 78 control the folding and unfolding of a leg 98; these mechanisms are also mirror images of each other about the plane P, such that only one leg folding mechanism will be described below.

For the sake of clarity, the bed 15 will be described initially in the unfolded position of FIGS. 2, 4 and 5; description of the movement to the folded position of FIGS. 1 and 3 will then follow. As used herein to describe the relative positions of components, the terms "lateral", "outward" and derivatives thereof indicate the directions defined by a vector beginning at the vertical plane P that bisects the seating unit 10 normal to the front wall 12 and extending toward either side wall 14. Conversely, the terms "inward", "inboard" and derivatives thereof indicate the direction opposite the "outward" direction. Together, the "inward" and "outward" directions comprise the "transverse" axis of the seating unit 10. The "rear" of the unfolded bed 15 is located at the end of the bed 15 nearest the rear wall of the base 11 (i.e., toward the subseat section 20), and the "front" of the bed 15 is located at the end nearest the seat section 16. The "front" and "rear" directions comprise the "longitudinal" axis of the bed 15.

In addition, some components of the bed folding mechanisms 30 and the leg folding mechanisms 78 are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to FIGS. 2 and 4, the bed folding mechanism 30 includes a mounting bracket 32 that is fixed to the inboard side of the side wall 14. A rear subseat swing link 34 is attached to the mounting bracket 32 at a pivot 36 and extends upwardly and forwardly therefrom to a pivot 44 with a subseat side rail 42 attached to the subseat panel 22. A front subseat swing link 38 is attached to the mounting bracket 32 at a pivot 40 that is forward of the pivot 36 and extends upwardly and forwardly to a pivot 46 with the subseat side rail 42 that is forward of the pivot 44. The subseat swing links 34, 38 control the movement of the subseat section 20.

Referring again to FIGS. 2 and 4, a rear seat swing link 52 is attached to the mounting bracket 32 at a pivot 54. A front seat swing link 56 is attached to the mounting bracket 32 at a pivot 58 that is forward of the pivot 54. The rear and front seat swing links 52, 56 extend upwardly and forwardly to attach to a seat side rail 60 at pivots 62, 64, respectively. A cross-member 74 extends between the lower ends of the rear seat swing links 52 on opposite sides of the seating unit 10, and a cross-member 76 extends between the upper ends of the rear seat swing links 52. The seat swing links 52, 56 control the movement of the seat section 16.

Referring still to FIGS. 2 and 4, a tying link 66 couples the subseat swing links 34, 38 and the seat swing links 52, 56. The tying link 66 is attached to the rear subseat swing link at a pivot 68 and extends forwardly and slightly downwardly to a pivot 70 at the lower end of the rear seat swing link 52. Also, a spring 72 extends between a pin 32*a* on the mounting bracket 32 and a pin 52*a* on the rear end of the rear seat swing link 52 just above the pivot 70.

Referring again to FIGS. 2 and 4, the leg folding mechanism 78 includes a transition link 80 that is attached at one end to the forward portion of the front seat swing link 56 at a pivot 82 that is located just rearwardly of the pivot 64. The transition link 80 extends forwardly and slightly downwardly to a pivot 88 with a bell crank 84 that is attached to the seat side rail 60 at a pivot 86. A leg drive link 90 extends forwardly from a pivot 87 with the bell crank 84 to a pivot 97 with a leg extension link 94. The leg extension link 94 is attached to the seat side rail 60 at a pivot 96 and extends downwardly therefrom. The leg 98 (which includes a foot 99 that spans the low ends of the legs 98 on opposite sides of the bed 15) is attached to the lower end of the leg extension link 94 at a pivot 100. A cross-member 101 extends between the upper ends of the foot 99. A brace 102 extends between a pivot 104 with the leg 98 and a pivot 106 at the forward end of the seat side rail 60.

It should be noted that, in the unfolded position of FIGS. 2, 4 and 5, the cushions 16*a*, 20*a* are substantially level with each other and form a sleeping surface. Typically, the cushions 16*a*, 20*a* measure between about 53 and 60 inches in the longitudinal direction (which is generally the typical dimension of a double bed), and between about 70 and 80 inches in the transverse direction (i.e., between the arms 14*a*). The rear edge of the cushion 16*a* is angled to face downwardly, and the front edge of the cushion 20*a* is angled to face upwardly, which enables them to mate when the bed 15 is unfolded. The angle of the front edges is typically between about 30 and 50 degrees to horizontal.

In the unfolded position of FIGS. 2, 4 and 5, the leg folding mechanism 78 is stabilized by the interaction between the rear edge of the brace 102 and a pin 98*a* on the leg 98. Also, a pin 80*a* on the transition link 80 (which is collinear with the pivot 82) fits in a notch 60*a* in the seat side rail 60 to further stabilize the unfolded bed 15. In addition, the pivots 86, 87, 97 form an "over-center" configuration that helps to maintain the bed 15 in the unfolded position, as do pivots 58, 70, 68.

To move the bed from the unfolded position of FIGS. 2, 4 and 5 to the folded position of FIGS. 1 and 3, an operator lifts the front end of the seat section 16. As the seat section 16 rises, it moves rearwardly also, controlled by the rear and front seat swing links 52, 56 as they pivot counterclockwise about the pivots 54, 58. The counterclockwise rotation of the front seat swing link 56 relative to the seat side rail 60 about the pivot 64 also draws the transition link 80 forwardly relative to the seat section 16. This action pivots the bell crank 84 counterclockwise about the pivot 86, which in turn draws the leg drive link 90 rearwardly. Rearward movement of the leg drive link 90 rotates the leg extension link 94 clockwise about the pivot 96. The motion of the leg extension link 94 draws the upper end of the leg 98 rearwardly and causes it to rotate counterclockwise (controlled by the brace 102). The leg 98 continues to move until it is horizontal and in a retracted position adjacent and underneath the leg extension link 94. Movement ceases when the lower edge of the leg extension link 94 contacts the pin 98*a* (see FIGS. 1 and 3).

In addition, the counterclockwise rotation of the rear seat swing link 52 forces the tying link 66 forwardly. The forward movement of the tying link 66 draws the rear subseat swing link 34 clockwise around the pivot 36. Rotation of the rear subseat swing link 34 (and in concert the front subseat swing link 38) lowers the subseat section 20 and moves it forward. Movement ceases when the lower front edge of the seat section 16 contacts the upper edge of the front wall 12. Although disposed generally horizontally, the seat section 16 is typically slightly "pitched" at an angle of between about 3 and 7 degrees to horizontal to provide a comfortable seating surface.

It should also be noted that the spring 72 is stretched during the last portion of the folding action; as the rear seat swing link 52 pivots counterclockwise about the pivot 54, the lower end of the rear seat swing link moves forwardly, thereby moving the pin 52*a* away from the pin 32*a*. The tension in the spring 72 resists the folding motion, which can prevent "slamming" of the bed 15 (which can be quite heavy) during the folding motion. The spring 72 may be replaced with another biasing unit (e.g., a gas cylinder or the like), or may be omitted in some embodiments.

It should be noted that, during movement from the unfolded position to the folded position, the leg folding mechanism 78 and the bed folding mechanism 30 are configured so that the seat section 16 is sufficiently high and the leg 98 folds sufficiently early in the motion that the leg 98 can clear the front wall 12 of the base 10. At its peak, the seat section 16 is between about 6 and 9 inches above its position in the folded position.

To unfold the bed 15 from the folded position, an operator lifts the front end of the seat section 16 and pulls it forwardly. The bed folding mechanism 30 unfolds the seat and subseat sections 16, 20 by reversing the motions of the links described above. Initial tension in the spring 72 can assist in the unfolding of the bed 15. The leg folding mechanism 78 reverses its movements to move the leg 98 from the retracted position to the extended position underneath the seat section 16 shown in FIGS. 2 and 4. Toward the end of the unfolding motion, the spring 72 begins to stretch again to resist the unfolding motion and prevent slamming of the bed 15. Notably, the path followed by the seat section 16 near the end of its movement to the unfolded position is at an angle that approximates the angle defined by the front edge of the cushion 20*a* and the rear edge of the cushion 16*a*, such that these edges essentially "slide" past each other at the end of the movement.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A foldable sofa-bed, comprising:

a base having a cavity;

a bed with a seat section and a subseat section, each of the seat section and the subseat section including a cushion and an underlying panel; and a bed folding mechanism attached to the base, subseat and seat, the bed folding mechanism configured to move the bed between a folded position, in which the seat and subseat sections are generally horizontally disposed and positioned in vertically stacked relationship in the cavity of the base, with the seat and subseat cushions facing upwardly, and an unfolded position, in which the seat and subseat sections are horizontally disposed and aligned to form a sleeping surface;

wherein in moving from the unfolded position to the folded position, the subseat section moves forwardly relative to the base; and wherein the bed folding mechanism includes:

front and rear subseat swing links directly pivotally attached to the base and to the subseat section;

front and rear seat links pivotally attached to the base and to the seat section; and a tying link directly pivotally attached to one of the front and rear subseat swing links and one of the front and rear seat swing links.

2. The foldable bed defined in claim 1, wherein a portion of the seat is positioned forwardly of the base in the unfolded position.

3. The foldable bed defined in claim 1, wherein a rear edge of the seat section engages a front edge of the subseat section in the unfolded position.

4. The foldable bed defined in claim 1, wherein the rear edge of the seat section is angled to face downwardly, and the front edge of the subseat section is angled to face upwardly.

5. The foldable bed defined in claim 1, wherein the sleeping surface formed by the seat and subseat cushions is between about 53 and 60 inches in the longitudinal dimension.

6. The foldable bed defined in claim 1, further comprising a leg pivotally attached to the seat section and a leg folding mechanism attached to the leg and to the seat section, the leg folding mechanism configured to move the leg between an extended position and a retracted position under the seat section.

7. The foldable bed defined in claim 6, wherein the leg folding mechanism is coupled to the folding mechanism, such that the leg takes the extended position when the bed is in the unfolded position and the leg takes the retracted position when the bed is in the folded position.

8. The foldable bed defined in claim 1, wherein the folding mechanism includes a biasing unit that biases the bed toward the unfolded position as the bed moves toward the folded position and biases the bed toward the folded position as the bed moves toward the unfolded position.

9. A foldable sofa-bed, comprising:

a base having a cavity;

a bed with a seat section and a subseat section, each of the seat section and the subseat section including a cushion and an underlying panel; and a bed folding mechanism attached to the base, subseat and seat, the bed folding mechanism configured to move the bed between a folded position, in which the seat and subseat sections are generally horizontally disposed and positioned in vertically stacked relationship in the cavity of the base, with the seat and subseat cushions facing upwardly, and an unfolded position, in which the seat and subseat sections are horizontally disposed and aligned to form a sleeping surface;

wherein in moving from the unfolded position to the folded position, the subseat section moves forwardly relative to the base; and further comprising a leg and a leg folding mechanism attached to the leg and to the seat section, the leg folding mechanism configured to move the leg between a fully extended position and a retracted position under the seat section;

wherein the leg folding mechanism includes a brace directly pivotally attached to the leg and to the seat section and a leg extension link that is directly pivotally attached to the leg and to the seat section, the leg extension link being oriented generally vertically in the fully extended position;

wherein the leg folding mechanism is coupled to the folding mechanism, such that the folding mechanism drives the leg to the extended position when the bed is in the unfolded position and to the retracted position when the bed is in the folded position.

* * * * *